United States Patent [19]

Rolfs

[11] Patent Number: 4,825,922

[45] Date of Patent: May 2, 1989

[54] SECURITY DEVICE FOR WALLETS, BILLFOLDS AND THE LIKE

[75] Inventor: Thomas J. Rolfs, West Bend, Wis.

[73] Assignee: Amity Leather Products Co., West Bend, Wis.

[21] Appl. No.: 164,525

[22] Filed: Mar. 7, 1988

[51] Int. Cl.[4] ..... A45G 1/00

[52] U.S. Cl. ..... 150/134

[58] Field of Search ..... 150/134

[56] References Cited

U.S. PATENT DOCUMENTS

| | | | |
|---|---|---|---|
| D. 279,423 | 7/1985 | Zucker | D2/378 |
| 377,373 | 2/1888 | Ebert | 150/134 |
| 889,436 | 6/1908 | Bustanoby | 150/134 |
| 1,148,825 | 8/1915 | Burdell | 150/134 |
| 1,265,824 | 5/1918 | Smith | 150/134 |
| 1,519,142 | 12/1924 | Lakin | 150/134 |
| 2,152,133 | 3/1939 | Brousseau | 24/3 |
| 2,807,303 | 9/1957 | Schulhoff | 150/134 |
| 2,834,389 | 5/1958 | Major | 150/134 |
| 4,002,194 | 1/1977 | Wright, Sr. | 150/134 |

FOREIGN PATENT DOCUMENTS

| | | | |
|---|---|---|---|
| 560239 | 4/1957 | Italy | 150/134 |
| 404085 | 1/1934 | United Kingdom | 150/134 |

OTHER PUBLICATIONS

Idea Marketing, "STOP-A-THIEF Wallet Protector", Feb. 3, 1988

*Primary Examiner*—William Price

*Attorney, Agent, or Firm*—Fitch, Even, Tabin & Flannery

[57] ABSTRACT

A security device which includes a single flexible, resilient tab extending from a wallet, billfold or the like at an acute angle for preventing undetected removal of the article from a pocket. The tab is preferably configured so that it can be temporarily depressed by a person's finger to facilitate legitimate removal of the associated article by the owner.

7 Claims, 1 Drawing Sheet

SECURITY DEVICE FOR WALLETS, BILLFOLDS AND THE LIKE

BACKGROUND OF THE INVENTION

The invention relates to articles such as wallets, billfolds and the like, and more particularly to a security device for such articles.

It is well known that relatively flat articles that are frequently carried in packets, such as wallets, billfolds and the like, are susceptible to loss due to pickpocketing, or accidental causes. Past efforts to prevent undetected loss of such articles have included provision of chains or other tethers, and provision of projections or high friction materials on the articles to engage pocket material. Both approaches have disadvantages.

Provision of a tether or the like restricts the owner's handling of the article, and provision of projections, high-friction materials or the like may unacceptably impede the owner's removal of the article from his own pocket. Another problem with some proposed security devices is that they present an unattractive appearance. In high quality leather articles, appearance is important, and a security device which detracts significantly from the esthetic appeal of such an article may be commercially unacceptable, regardless of its efficacy.

It is a general object of the invention to provide a security device which addresses the above problems and is particularly effective in thwarting pickpockets.

SUMMARY OF THE INVENTION

The invention comprises a security device which includes a flexible, resilient tab extending from a wallet, billfold, or the like, at an acute angle, for preventing undetected removal of the article from a pocket. The tab is configured so that its distal end engages pocket material when an attempt is made to remove the article from the pocket while the tab is in its normal position. The tab is configured so that it can be temporarily depressed by a person's finger to facilitate legitimate removal of an article, as by the owner. To this end, the tab has a width of less than about one inch, and is sufficiently flexible that the pressure of one finger is sufficient to displace it into contact with the wallet.

In a preferred embodiment of the invention, the tab extends through an opening in an outer wall of the article to which it is attached, and is anchored in place by a base member disposed under the outer wall of the article. The base member is preferably sized larger than the opening and glued to the inner surface of the outer wall.

The device performs optimally when the tab is extending in a generally upward direction in the pocket. Performance may be enhanced when the device is secured to a wallet or the like so that the wallet may be placed in a pocket in an upwardly-opening position, with the tab also oriented upwardly. In this configuration, upward displacement of the wallet may tend to open the wallet somewhat, in addition to bending the tab outward from the wallet, as the wallet is moved upward while the tab engages the interior of the pocket.

DETAILED DESCRIPTION OF THE PREFERRED EMBODIMENT

The invention is generally embodied in a security device for pocket-held articles such as wallets, billfolds and the like, and in the combination of the security device with such articles.

Figure 1:
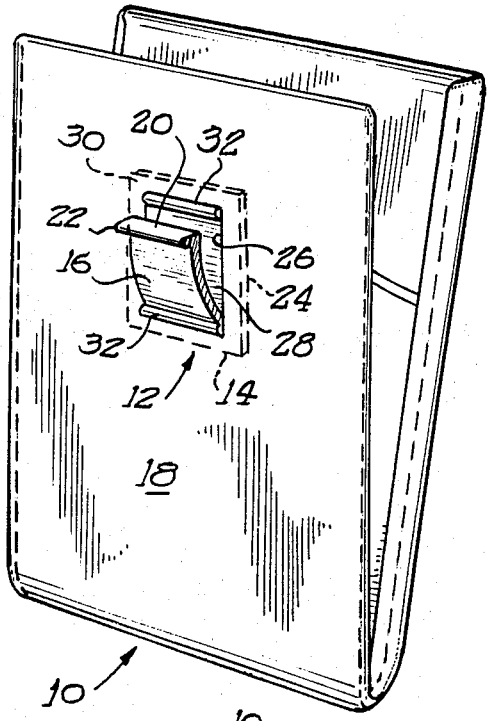
FIG. 1 is a perspective view of a wallet including a security device in accordance with the invention.
Figure 4:
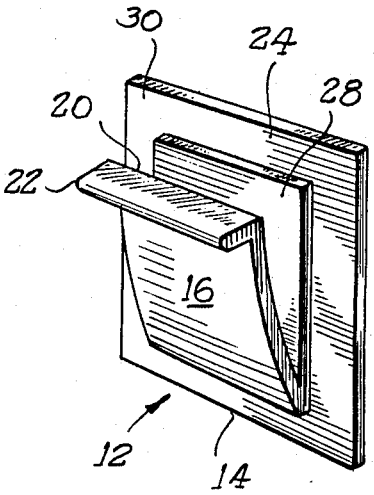
FIG. 4 is a perspective view of the security device of the wallet of FIG. 1.

FIG. 1 illustrates a wallet 10 in combination with a security device 12 in accordance with the invention. The preferred security device 12 includes a base member 14 and a flexible, resilient tab 16 which is movable relative thereto. The tab 16 extends from an outer wall 18 of the wallet at an acute angle to prevent undetected removal of the wallet from a pocket. The tab 16 is configured so that its distal end 20 engages pocket material when an attempt is made to remove the article from the pocket when the tab is in its normal extended position.

In accordance with one feature of the invention, the tab 16 is preferably configured so that it can be temporarily depressed by a person's finger to facilitate legitimate removal of the wallet by the owner. To this end, the tab has a width of about ½ in. to ¾ in., and is sufficiently flexible that its distal end may be depressed into contact with the base 14 by pressure applied with one finger. In its normal or undeflected position, the tab 16 extends at an angle of about 15° to the adjacent outer wall 18 of the wallet. The tab has a bead or ridge 22 extending transversely across its distal end.

The tab 16 is generally rectangular in shape, and the base member 14 is also rectangular in shape, but larger. The tab preferably has a length of about ¾ in., a width of about ⅝ in., and a thickness of about 1/16 in. over its entire area except for the bead 22. The base 14 is stepped, comprising a relatively thin peripheral flange 24 surrounding a thicker central portion 28 from which the tab 16 extends. The outer wall 18 of the wallet 10 is provided with a rectangular opening 26 sized slightly larger than the central portion 28 of the base 14 of the security device 12. The flange 24 is thin enough that it can be positioned under the outer wall of the wallet without greatly adding to the thickness of the wallet adjacent the opening 26. The flange 24 permits attachment of the security device 12 by gluing the outwardly facing surface 30 of the flange 24 to the adjacent inner surface of the outer wall 18 of the wallet 10. Thus, the central portion 28 is visible in the opening 26 in the outer wall 18. The difference between the central portion 28 and the flange 24 is about equal to the thickness of the outer wall 18 of the wallet, so that the outer surface of the central portion 28 is substantially flush with the outer surface of the outer wall 18.

Metal rim members 32 are provided along two edges of the opening 26. The rim members 32 shown are of generally C-shaped cross-section, receiving the adjacent edges of the wall 18, and are pinched to grip the sidewall adjacent the opening.

Figure 2:
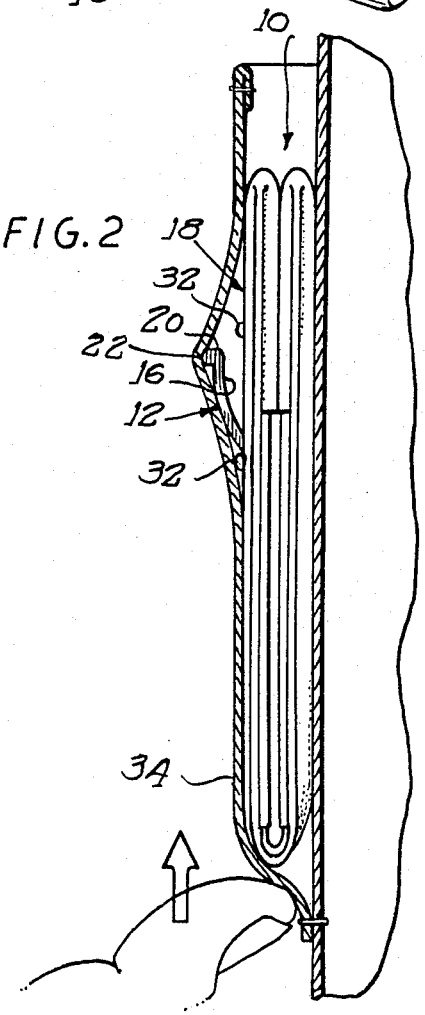
FIG. 2 is a side elevational view of the wallet of FIG. 1, shown in a wearer's pocket.
Figure 3:
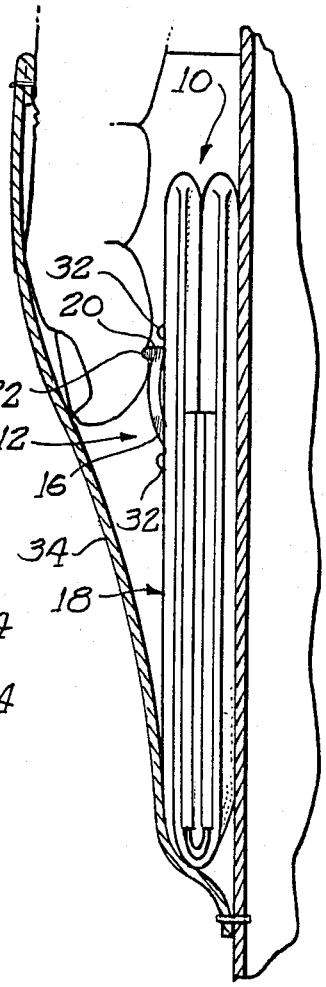
FIG. 3 is a side elevational view of the wallet of FIG. 1, showing the security device in a depressed position.
Figure 5:
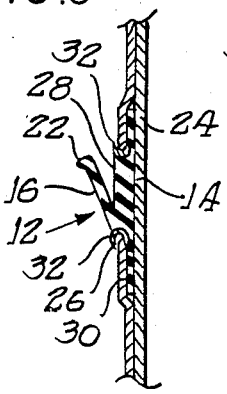
FIG. 5 is a longitudinal sectional view of the security device and adjacent portions of the wallet.

It is believed that pickpockets frequently extract walls from pockets of clothing by first applying upward force to the bottom of the wallet through the pocket material, causing the upper end of the wallet to protrude from the pocket, then gripping the exposed upper portion of the wallet and removing it entirely from the pocket. The security device 12 in accordance with the invention makes it difficult for this process to occur undetected, by engaging the pocket material 34. Thus, as illustrated in FIG. 2, when upward force is applied to the bottom of the wallet 10 through the pocket material 34, the tab 16 provides substantial resistance to the upward force, and tends to pull the pocket material 34 upward with the wallet, preventing or resisting movement of the wall 10 relative to the pocket material 34. The bead 22 provides additional resistance to upward movement of the wallet by frictional engagement with the pocket material, as well as physical engagement with the pocket seams.

In FIG. 2, the tab 16 is shown engaging the outside of the pocket. It will be appreciated that the wallet 10 can be reversed so that the tab 16 engages the inside of the pocket. The latter orientation may provide an advantage in that movement of the tab 16 along the inside of the pocket may be detected by the user more readily than the smooth opposite outside wall of the wallet in the event of an attempted theft. However, this orientation may have a disadvantage in that, if the wallet is being carried in a person's back pocket, the tab may be a source of discomfort when the person is seated.

As illustrated in FIG. 2, the tab 16 is most effective when oriented in an upwardly extending position in the pocket. Also, the orientation of the wallet in an upwardly opening position may contribute to the effectiveness of the tab. This is in part because the wallet is foldable about an axis which is parallel to the line along which the tab 16 adjoins to the base member 14, so that in the event of an attempted pickpocket, the forces acting on the wallet and security device may tend to open the wallet while also tending to increase the angle between the tab and the base member, thus increasing resistance to upward displacement.

Where the security device is part of a high quality leather wallet or the like, its appearance is important. Accordingly, the proportions and shape of the tab, bead, and other parts of the security device, and their orientation on and proportions to the wallet, may by influenced by aesthetic considerations in addition to the various other considerations set forth herein.

From the foregoing, it will be appreciated that the invention provides a relatively inexpensive and convenient means for increasing security in connection with pocket-held articles such as wallets, billfolds and the like. The invention is not limited to the embodiment described above, but is defined by the following claims.

What is claimed is:

1. In combination with a flat article which has at least one smooth outer wall and which is sized and configured for insertion in a pocket of an article of clothing, a security device comprising a single flexible, resilient tab extending outward from the outer wall of the article at an acute angle to said outer wall;

the tab having a distal end for engaging pocket material and preventing undetected removal of the article from a pocket;

said tab having a bead along the width of the distal end for providing resistance to upward movement of the article in the pocket by frictional engagement with the pocket;

said outer wall being substantially free of projections except for said tab;

said tab having a width of less than 1 in., and being sufficiently flexible that said distal end can be deflected, by pressure from a person's finger, into contact with said outer wall, to facilitate legitimate removal of the article from a pocket.

2. A combination in accordance with claim 1 wherein the security device includes, in addition to said flexible, resilient tab, a base member which is attachable to the article and which is integral with said tab so as to secure said tab to said article.

3. A combination in accordance with claim 2 wherein the outer wall of the article has an opening therein, and wherein the base member of the security device comprises a generally rectangular member larger than the opening in the outer wall of the article for anchoring the security device in place with the tab protruding through the opening.

4. A combination in accordance with claim 2 wherein the article is foldable about a predetermined axis and the tab is connected to said base member along a line substantially parallel to said axis.

5. A wallet comprising:

an outer wall having inner and outer surfaces;

at least one inner wall; and a security device;

said outer wall having an opening therein;

said security device extending through said opening in said outer wall and comprising a base member larger than the opening in said outer wall and a flexible tab protruding from said base member at an acute angle to the outer wall, said base member having a central portion of predetermined thickness supporrting said tab and a peripheral flange of thickness less than that of said central portion;

said peripheral flange being attached by adhesive to the inner surface of said outer wall;

said outer wall of said wallet being free of projections other than said tab;

said tab being made of an elastomeric material;

said tab being substantially rectangular and having a horizontal dimension between $\frac{1}{2}$ in. and 1 in., a vertical dimension of between $\frac{1}{2}$ in. and 1 in., and a thickness of less than about $\frac{1}{8}$ in. over a major portion of its area.

6. A wallet in accordance with claim 5 wherein said base member includes a central portion similar in size and configuration to said opening and being disposed so as to substantially fill said opening, said central portion providing an outer surface generally flush with the outer surface of the outer wall.

7. A wallet in accordance with claim 5 wherein said tab and said base member are integral with one another.

* * * * *

UNITED STATES PATENT AND TRADEMARK OFFICE

CERTIFICATE OF CORRECTION

PATENT NO. : 4,825,922

DATED : May 2, 1989

INVENTOR(S) : Thomas J. Rolfs

It is certified that error appears in the above-identified patent and that said Letters Patent is hereby corrected as shown below:

Column 1, line 11, change "packets" to --pockets--.

Column 2, line 64, change "walls" to --wallets--.

Column 3, line 9, change "wall" to --wallet--.

Column 3, line 41, change "by" to --be--.

Column 4, line 39, change "supporrting" to --supporting--.

Signed and Sealed this

Fifth Day of December, 1989

*Attest:*

JEFFREY M. SAMUELS

*Attesting Officer*

*Acting Commissioner of Patents and Trademarks*